US008298016B2

(12) United States Patent
Lai et al.

(10) Patent No.: US 8,298,016 B2
(45) Date of Patent: Oct. 30, 2012

(54) CONNECTOR HAVING A SHIELD WITH WITH SPRING ARMS IN LENGTHWISE AND CROSSWISE DIRECTIONS

(75) Inventors: Chih-Ming Lai, Taipei Hsien (TW); Yung-Shun Kao, Taipei Hsien (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 0 days.

(21) Appl. No.: 13/308,544

(22) Filed: Dec. 1, 2011

(65) Prior Publication Data

US 2012/0071028 A1 Mar. 22, 2012

Related U.S. Application Data

(63) Continuation-in-part of application No. 12/540,066, filed on Aug. 12, 2009, now Pat. No. 8,096,834.

(51) Int. Cl.
*H01R 13/648* (2006.01)

(52) U.S. Cl. ..... 439/607.28

(58) Field of Classification Search ..... 439/607.01, 439/607.07, 607.08, 607.28, 108
See application file for complete search history.

(56) References Cited

U.S. PATENT DOCUMENTS

| | | | | |
|---|---|---|---|---|
| 5,178,562 | A * | 1/1993 | Ermini | 439/607.19 |
| 5,500,788 | A * | 3/1996 | Longueville et al. | 361/800 |
| 5,685,739 | A * | 11/1997 | Davis et al. | 439/607.38 |
| 6,368,154 | B1 * | 4/2002 | Hirata et al. | 439/607.17 |
| 7,086,901 | B2 * | 8/2006 | Zhang | 439/607.56 |
| 7,322,854 | B2 * | 1/2008 | Long et al. | 439/607.28 |
| 8,096,834 | B2 * | 1/2012 | Lai et al. | 439/607.28 |

* cited by examiner

*Primary Examiner* — Chandrika Prasad
(74) *Attorney, Agent, or Firm* — Chun-Ming Shih

(57) ABSTRACT

A connector to be disposed within a housing of an electronic device includes a main body and a conduction member. The conduction member includes a connecting portion and a resilient portion. The resilient portion is formed on the connecting portion and configured to abut against the housing. An EMI shield being formed on the housing, which includes at least one spring arm in the lengthwise direction and at least one spring arm in the crosswise direction on the EMI shield are sited to fixate the connection between the connector and the electronic device.

22 Claims, 4 Drawing Sheets

CONNECTOR HAVING A SHIELD WITH WITH SPRING ARMS IN LENGTHWISE AND CROSSWISE DIRECTIONS

CROSS-REFERENCE TO RELATED APPLICATIONS

This application is a continuation-in-part (CIP) of U.S. application Ser. No. 12/540,066 filed on Aug. 12, 2009 now U.S. Pat. No. 8,096,834, which claims the benefit of priority to Taiwan application filed Jun. 30, 2009. The entire disclosure of U.S. Application No. is incorporated herein by reference.

BACKGROUND OF THE INVENTION

1. Field of the Invention

The present inventions relates to connectors and electronic devices, and more particularly, to a connector which provides a good electromagnetic conduction mechanism for electronic devices.

2. Description of the Prior Art

In electronic devices, the electromagnetic interference (EMI) has two typical paths to follow when leaving or entering an electronic circuit: a radiated path and a conducted path. That is, the EMI may leak out of gaps, slots, openings and any discontinuities that may be present in a housing of the electronic device. The EMI may also be coupled to and hence travel over power, signal and control lines to leave the housing. If a connector is provided with a good electromagnetic conduction mechanism, the electronic device using the connector can be free of interferences of static electricity or electromagnetic waves and also the electronic device itself cannot be a source of EMI. This is particularly true for a high definition multimedia interface (HDMI) connector.

SUMMARY OF THE INVENTION

The present invention provides a connector configured to be disposed within a housing of an electronic device. The connector includes a main body and a conduction member. The conduction member includes a connecting portion and a resilient portion. The resilient portion is formed on the connecting portion and configured to abut against the housing.

In one aspect, the conduction member and the main body are integrally formed, and the connecting portion and the resilient portion are integrally formed.

In another aspect, the connecting portion has an opening, and the resilient portion extends from an edge of the opening into the opening and includes a bent section.

In another aspect, the connecting portion is oriented substantially perpendicular to the main body and has a surface oriented toward the housing, and the resilient portion protrudes beyond the surface.

In another aspect, a connection terminal set is disposed in the main body, and the connection terminal set comprises a plurality of conductive pins.

In another aspect, the main body and the conduction member are made of metal.

In another aspect, the connector is a high definition multimedia interface (HDMI) connector.

In another aspect, the main body comprises a metal housing and an insulative housing, and the conduction member and the metal housing are integrally formed.

The present invention also provides an electronic system in which the connector is deposited. Besides the connector, the system also includes an electronic device and an EMI shield. The electronic device includes a housing, and the EMI shield is formed on the housing of the electronic device. The EMI shield includes at least one spring arm in the lengthwise direction and at least one spring arm in the crosswise direction to fix the connection between the connector and the electronic device.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
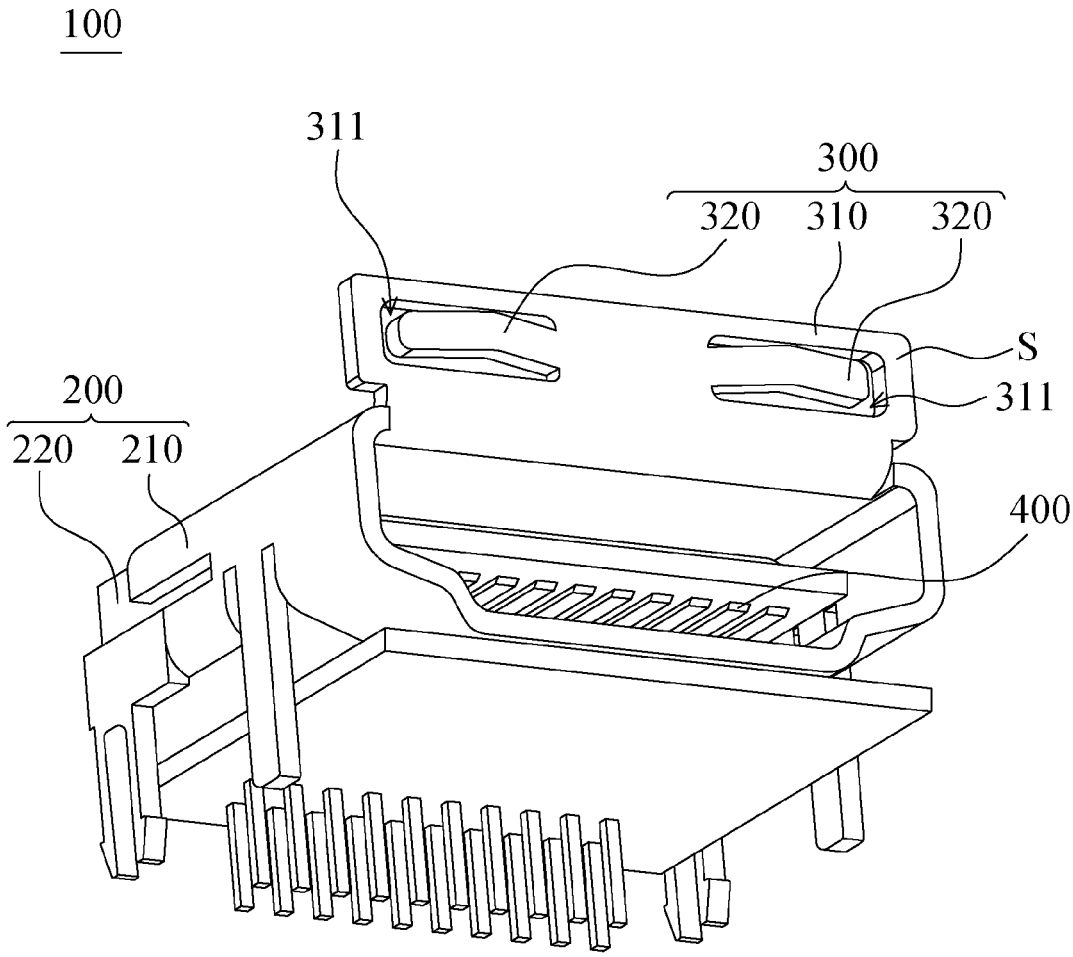
FIG. 1 illustrates a connector according to one embodiment of the present invention.
Figure 2:
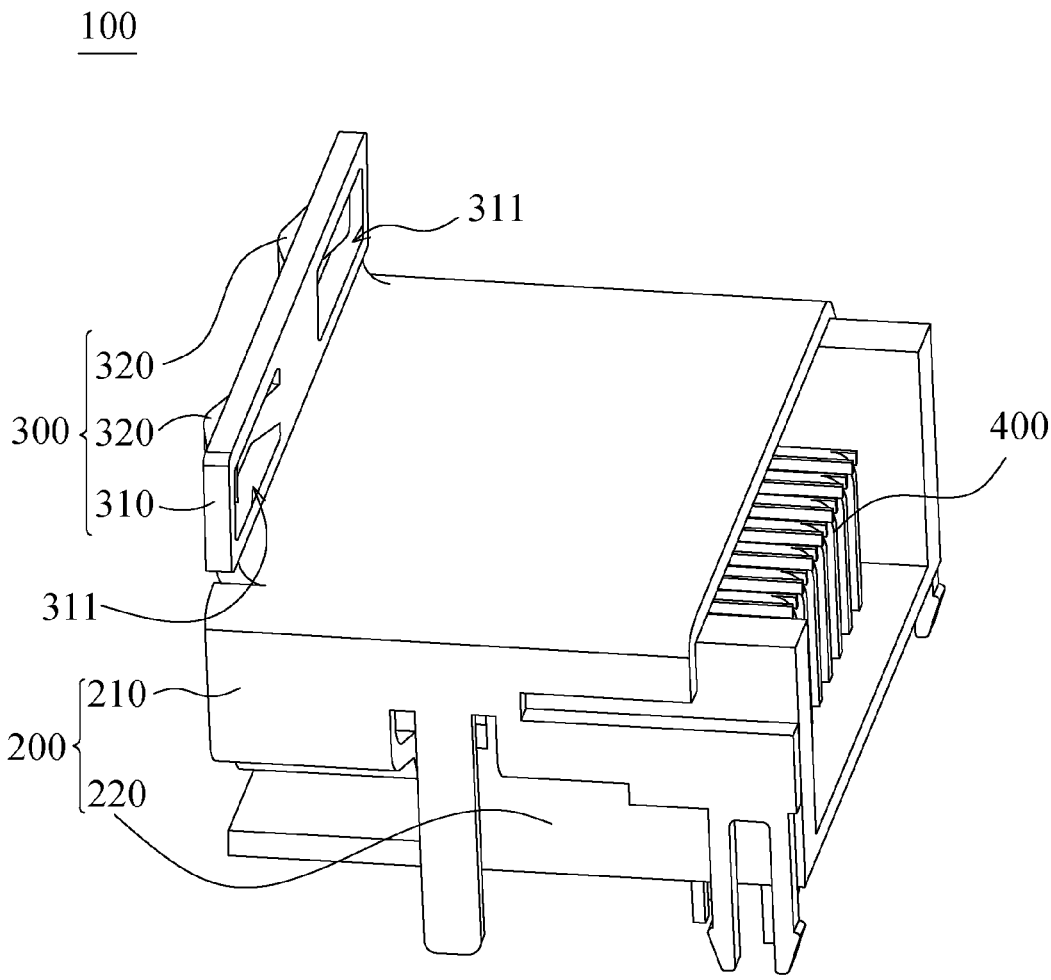
FIG. 2 illustrates the connector of FIG. 1, but viewed from another aspect.
Figure 3:
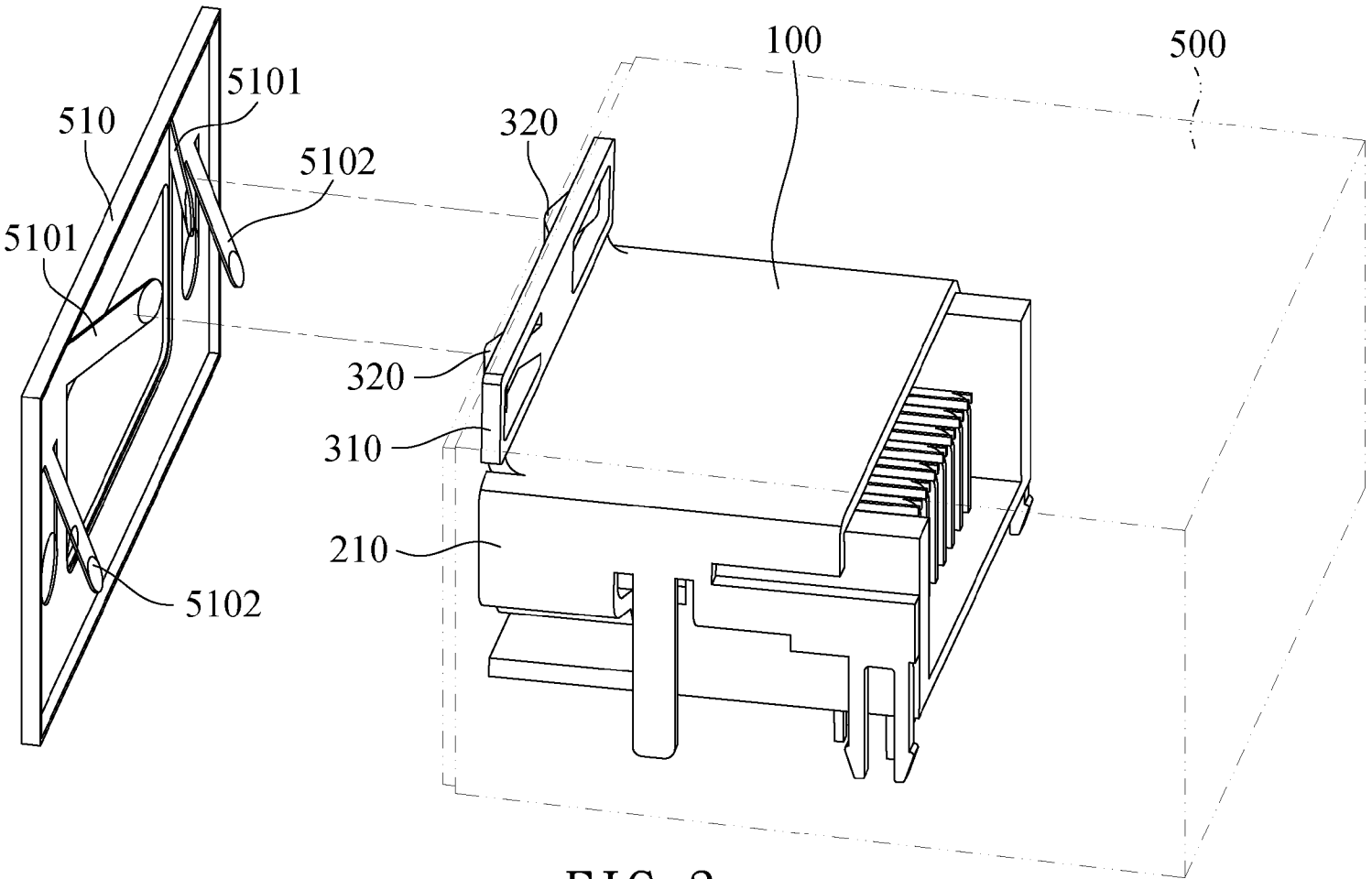
FIG. 3 illustrates a breakdown view of an electronic system according to another embodiment of the present invention.
Figure 4:
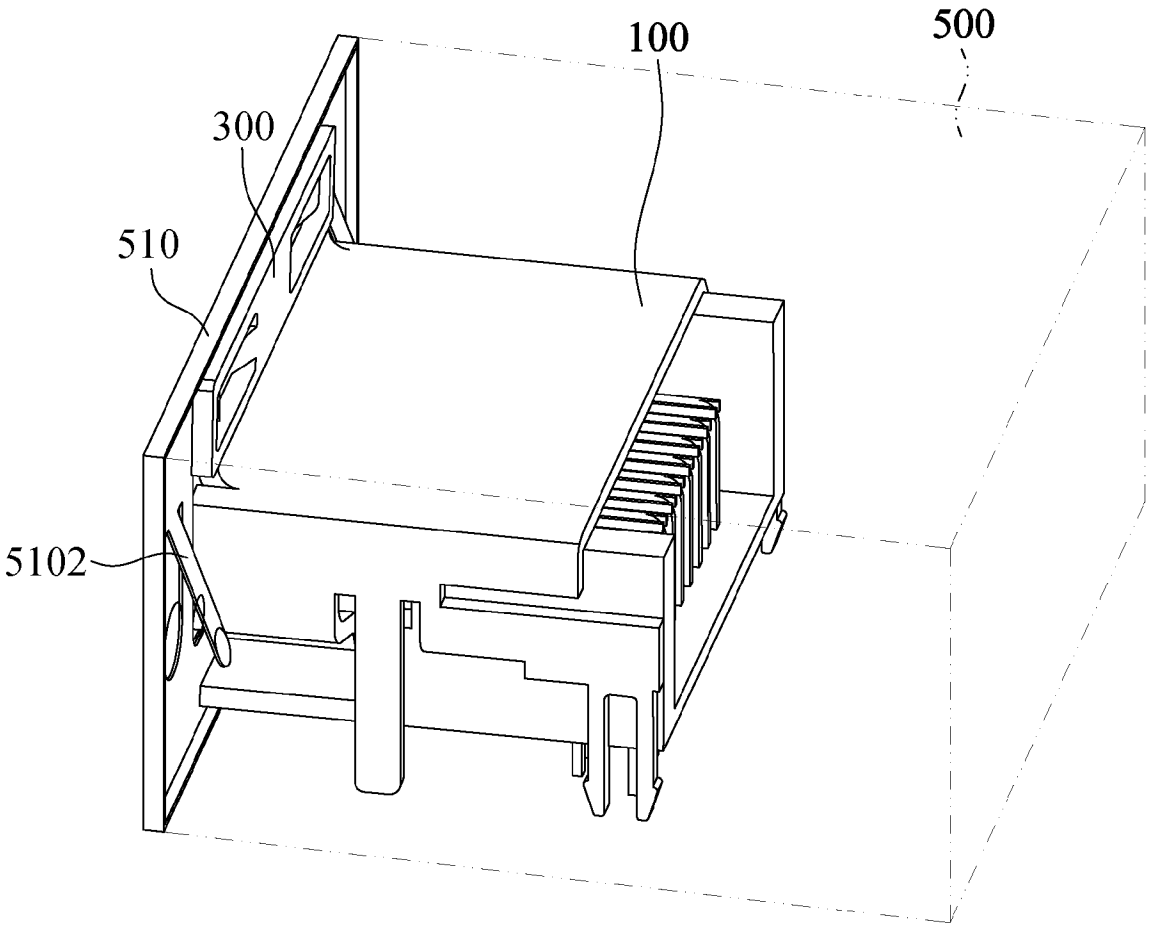
FIG. 4 illustrates a side view of the electronic system according to another embodiment of the present invention.

Referring to FIG. 1, FIG. 2, FIG. 3 and FIG. 4, the illustrated connector 100 is an HDMI connector to be disposed within a housing of an electronic device 500 and can be connected with an HDMI cable. The connector 100 includes a main body 200, a conduction member 300, and a connection terminal set 400. An EMI shield 510 is generally formed on the housing of the electronic device 500, the EMI shield 510 further includes at least one spring arm 5101 in the lengthwise direction and at least one spring arm 5102 in the crosswise direction, both the spring arms 5101 and 5102 are sited to fixate the connection between the connector 100 and the electronic device 500. The number of both the spring arm 5101 and 5102 can be varied based upon actual requirements in alternative embodiments. With the conduction member 300 abutting against the EMI shield 510 of the housing, the conducted EMI can be effectively reduced.

The main body 200 includes a metal housing 210 and an insulative housing 220. The conduction member 300 and the metal housing 210 are integrally formed of metal. The connection terminal set 400 having a plurality of conductive pins is disposed in the main body 200.

The conduction member 300 includes a connecting portion 310 and two resilient portions 320. The connecting portion 310 of the conduction member 300 is connected to the metal housing 210 and is oriented substantially perpendicular to the main body 200. The connecting portion 310 has a surface S (as shown in FIG. 1) and two openings 311. Both resilient portions 320 are integrally formed with the connecting portion 310. Each resilient portion 320 extends from an edge of a corresponding opening 311 into the opening 311, with a bent section of the resilient portion 320 protruding beyond the surface S of the connecting portion 310.

While the conduction member 300 is illustrated as having two resilient portions 320 in the present embodiment, it is to be understood that this is for the purpose of description only and should not be regarded as limiting. Rather, the number of the resilient portions 320 can be varied based upon actual requirements in alternative embodiments and the number of the openings 311 can also be varied corresponding to the resilient portions 320.

When the connector 100 is disposed in the electronic device 500, the surface S of the connector 310 is oriented toward the housing of the electronic device 500 and the bent sections of the resilient portions 320 protrude in a direction away from the surface S (i.e., in the direction toward the housing of the electronic device 500 to abut against the EMI shield 510 of the housing. The conduction member 300 can be closely abutted against the EMI shield 510 under the resilient force of the resilient portions 320, which results in good electromagnetic conduction in the connector such that the conducted EMI can be effectively reduced or even eliminated.

The illustrated system which relates to the connector 100 mentioned above, as shown in FIG. 3 and FIG. 4, includes the electronic device 500, the EMI shield 510 and the connector 100. All the structures of the connector 100, electronic device 500 and the EMI shield 510 in the system as stated in the previous paragraphs provide good electromagnetic conduction in the connector 100, so that conducted EMI is effectively reduced or even eliminated.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A connector configured to be disposed within a housing of an electronic device, an EMI shield being formed on the housing, the EMI shield comprising at least one spring arm in the lengthwise direction and at least one spring arm in the crosswise direction, the connector comprising:

a main body comprising a plate surface; and a conduction member comprising a connecting portion and a resilient portion, the connecting portion being a plate to be extended from the plate surface and the resilient portion being formed on the connecting portion configured to abut against the EMI shield of the housing, as such the conduction member is closely abutted against the EMI shield under resilient force of the resilient portion, the spring arm in the lengthwise direction and the spring arm in the crosswise direction on the EMI shield are sited to fixate the connection between the connector and the electronic device, which results in good electromagnetic conduction in the connector so that conducted EMI is effectively reduced or even eliminated.

2. The connector according to claim 1, wherein the conduction member and the main body are integrally formed.

3. The connector according to claim 1, wherein the connecting portion and the resilient portion are integrally formed.

4. The connector according to claim 1, wherein the connecting portion has an opening, and the resilient portion extends from an edge of the opening into the opening and includes a bent section.

5. The connector according to claim 1, wherein the connecting portion is oriented substantially perpendicular to the main body and has a surface oriented toward the housing, and the resilient portion protrudes beyond the surface.

6. The connector according to claim 5, wherein when the connector is disposed in the electronic device, the surface is oriented toward the housing of the electronic device and a bent section of the resilient portion is protrude in a direction toward the housing of the electronic device to abut against the EMI shield.

7. The connector according to claim 1, further comprising a connection terminal set disposed in the main body.

8. The connector according to claim 7, wherein the connection terminal set comprises a plurality of conductive pins.

9. The connector according to claim 1, wherein the main body and the conduction member are made of metal.

10. The connector according to claim 1, wherein the connector is a high definition multimedia interface (HDMI) connector.

11. The connector according to claim 1, wherein the main body comprises a metal housing and an insulative housing, and the conduction member and the metal housing are integrally formed.

12. An electronic system, the system comprising:

an electronic device comprising a housing;

an EMI shield being formed on the housing of the electronic device, and the EMI shield comprising at least one spring arm in the lengthwise direction and at least one spring arm in the crosswise direction;

a connector, the connector configured to be disposed within the housing of the electronic device, the connector comprising a main body and a conduction member, the main body further comprising a plate surface and the conduction member further comprising a connecting portion and a resilient portion, wherein the connecting portion is a plate to be extended from the plate surface and the resilient portion is formed on the connecting portion configured to abut against the EMI shield of the housing, as such the conduction member is closely abutted against the EMI shield under resilient force of the resilient portion, the spring arm in the lengthwise direction and the spring arm in the crosswise direction on the EMI shield are sited to fixate the connection between the connector and the electronic device, which results in good electromagnetic conduction in the connector so that conducted EMI is effectively reduced or even eliminated.

13. The system according to claim 12, wherein the conduction member and the main body on the connector are integrally formed.

14. The system according to claim 12, wherein the connecting portion and the resilient portion on the connector are integrally formed.

15. The system according to claim 12, wherein the connecting portion has an opening, and the resilient portion extends from an edge of the opening into the opening and includes a bent section.

16. The system according to claim 12, wherein the connecting portion is oriented substantially perpendicular to the main body and has a surface oriented toward the housing, and the resilient portion protrudes beyond the surface.

17. The system according to claim 16, wherein when the connector is disposed in the electronic device, the surface is oriented toward the housing of the electronic device and a bent section of the resilient portion is protrude in a direction toward the housing of the electronic device to abut against the EMI shield.

18. The system according to claim 12, further comprising a connection terminal set disposed in the main body.

19. The system according to claim 18, wherein the connection terminal set comprises a plurality of conductive pins.

20. The system according to claim 12, wherein the main body and the conduction member are made of metal.

21. The system according to claim 12, wherein the connector is a high definition multimedia interface (HDMI) connector.

22. The system according to claim 12, wherein the main body comprises a metal housing and an insulative housing, and the conduction member and the metal housing are integrally formed.

* * * * *